United States Patent [19]

Brunn

[11] Patent Number: 4,663,561

[45] Date of Patent: May 5, 1987

[54] COLOR PICTURE TUBE WITH SHADOW MASK MOUNTING MEANS

[75] Inventor: Otto Brunn, Wernau, Fed. Rep. of Germany

[73] Assignee: Standard Elektrik Lorenz AG, Stuttgart, Fed. Rep. of Germany

[21] Appl. No.: 774,098

[22] Filed: Sep. 9, 1985

[30] Foreign Application Priority Data

Sep. 29, 1984 [DE] Fed. Rep. of Germany ..... 3435891

[51] Int. Cl.[4] ..... H01J 29/07

[52] U.S. Cl. ..... 313/406

[58] Field of Search ..... 313/406, 404, 407

[56] References Cited

U.S. PATENT DOCUMENTS 4,335,329 6/1982 Fukuzawa et al. ..... 313/406

4,387,321 6/1983 Gijrath et al. ..... 313/406

4,439,709 3/1984 Sohn ..... 313/406

*Primary Examiner*—Palmer C. DeMeo

*Attorney, Agent, or Firm*—Donald J. Lenkszus

[57] ABSTRACT

Hold members are used for abutting a shadow mask on the pins in the rim portion of the faceplate of a color picture tube. These hold members are of a two-part design and connected to one another with the aid of means permitting a transverse movement in relation to the axis of symmetry of the color picture tube. These means may consist either of a swivel joint or of a straight line motion device. During the first insertion of the shadow mask into the faceplate, any possible tolerances of the pins can be compensated for because the possible transverse movement of the hold members. The spacing between the shadow mask and the phosphor screen is not affected.

10 Claims, 8 Drawing Figures

COLOR PICTURE TUBE WITH SHADOW MASK MOUNTING MEANS

BACKGROUND OF THE INVENTION

The invention pertains to a color picture tube.

German OS No. 32 15 742 describes a type of color picture tube in which the pins for supporting the mask are fused under such an angle into the rim portion of the faceplate that its longitudinal axes extend parallel in relation to the electron beam deflected toward the respective corner. The free ends of the pins are conical, and the hold members are of a two-part design. A first part of the hold members has an almost triangular shape and is provided with a large hole at its end not secured to the mask. This hole is partially covered by a second part mounted to the first part, having a smaller opening. The openings in the second parts, are engaged by the pins when the picture tube is assembled.

Prior to installing the mask into the faceplate, the two parts of the hold members are not firmly connected to one another, but are held by springs and lugs. The mask is inserted into the faceplate by using or interposing a spacing gauge, and only thereafter the parts of the hold members are mounted to one another.

SUMMARY OF THE INVENTION

It is one object of the invention, to provide a color picture tube of the type mentioned hereinbefore, in which compensation of tolerances between the shadow mask and the pins in the faceplate is possible in the course of the first insertion, in a simple way and with the aid of simple hold members.

In accordance with the principles of the invention a color picture tube includes a plurality of support members to support a shadow mask at a predetermined distance from the phosphor screen and to automatically compensate for tolerances. The hold members are of two piece design and are connected to each other such that the two pieces may move relative to each other transversely in relation to the axis of symmetry of the picture tube. Each hold member is carried on one pin in the rim portion of the faceplate.

In accordance with the invention, the two pieces of each hold member are coupled either by a swivel joint or a straight line motion means. When the shadow mask is first inserted into the faceplate, any possible tolerances of the pins are compensated for by transverse movement of the hold members. The spacing between the shadow mask and the phosphor screen is not effected.

BRIEF DESCRIPTION OF THE DRAWING

The invention will be better understood from a reading of the following detailed description in conjunction with the drawing in which.

DETAILED DESCRIPTION

Figure 1:
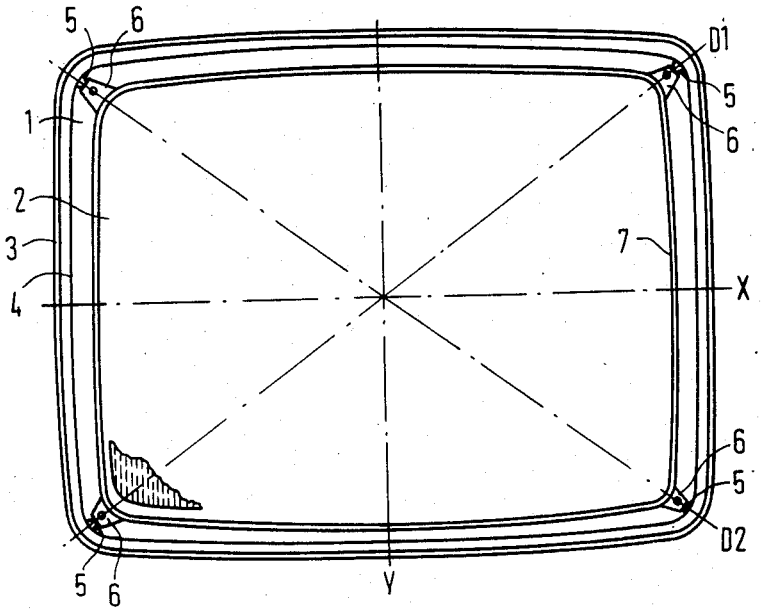
FIG. 1 is the top view of a face plate with a shadow mask inserted.

FIG. 1 shows only the faceplate 1 with the inserted shadow mask 2 of a conventional type of color picture tube. The X axis, the Y axis and the diagonals D1 and D2 are clearly shown. The surface of the rim porton 4 of the face plate 1 on which the faceplate is connected to the cone by means of solder glass (frit), is indicated by the reference numberal 3. Faceplate 1 carries the phosphor layer (not shown) on its inner side. At the point of intersection of the diagonals D1 and D2 with the rim portion 4 of the faceplate 1, pins 5 are provided which, via hold members 6, carry the shadow mask. The hold members 6 engage the rim portion 7 of the shadow mask 2.

The axis of symmetry (longitudinal axis) of the color picture tube, at the point of intersection of the X axis with the Y axis, is perpendicular to the drawing plane. The holding members for mask 2 do not absolutely have to be in the corners of the faceplate 1, but may equally well be provided for in the points of intersection of the X and Y axes with the rim portion 7 of the shadow mask 2 and the rim portion 4 of the faceplate 1.

Figure 2A:
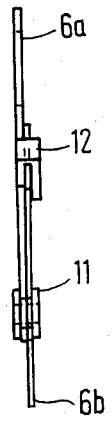
FIGS. 2A and 2B are the top and the side views, respectively, of a first embodiment of the hold members.
Figure 2B:
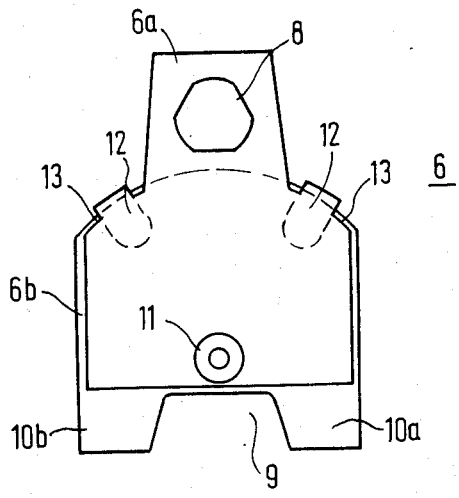

FIGS. 2A and 2B show a first embodiment of a hold member 6 in two different views. The hold member 6 consists of two parts **6*a* and 6*b* which overlap each other. Part 6*a* has an almost triangular hole 8 at its free end through which the pin 5 extends. Part 6*b* has a recess 9 at its free end. Recess 9 is symmetrically positioned in relation to the longitudinal axis of hold member 6, so that the part 6*b* ends in two prongs 10*a* and 10*b*. Prongs 10*a*, 10*b* are connected to the rim portion 7 of the shadow mask 2**.

Parts **6*a* and 6*b* are movable relative to one another by a swivel joint provided for in the overlapping area of the parts 6*a* and 6*b*. In this embodiment of the hold member 6, the swivel joint consists of a tubular rivet 11**.

The free end of the part **6*a* is narrower than its area covered by the part 6*b*. Because of this, part 6*a* has two shoulders 13, with the rim portion thereof lying on a circular arc. This circular arc is determined by a radius stretching from the tubular rivet 11 up to the shoulders 13. In the center of each shoulder 13 there is provided a guide flap 12. Both guide flaps 12 are laid around the rim portion of part 6*b*. This rim portion of part 6*b* forms part of a circular arc which is determined by the aforementioned radius. The longitudinal axes of guide flaps 12 pass through the tubular rivet 11. With this arrangement of the guide flaps 12, the two parts 6*a* and 6*b* of the hold member 6 are held almost in one plane, and the tubular rivet 11** is relieved without this affecting or restricting the rotary motion of the parts with respect to one another.

Figure 3A:
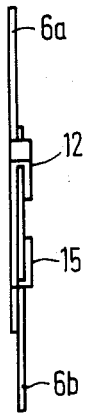
FIGS. 3A and 3B are top and side views, respectively, of a second embodiment of the hold members.
Figure 3B:
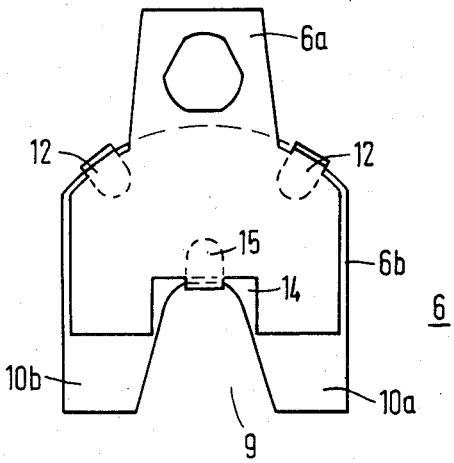

FIGS. 3A and 3B show a second embodiment of a hold member 6, in which the swivel joint, compared to that of the first embodiment, is of a more simple design. Part **6*a*, at its end covered by the part 6*b* has a cutout 14, and the recess 9 between the prongs 10*a*, 10*b* in part 6*b* extends to the bottom of the cutout 14. Near bottom of the cutout 14, the recess 9 is restricted by a circular arc. At the point of intersection of the longitudinal axis of the hold member 6 with the cutout 14, a guide flap 15 is disposed on part 6*a*. Flap 15 extends around the rim portion of the part 6*b* within the area of the recess 9. Accordingly, in this embodiment the swivel joint connecting the parts 6*a* and 6*b* is formed in a simple way by the two guide flaps 12 and by the guide flap 15** lying opposite to them.

Figure 4A:
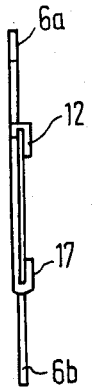
FIGS. 4A and 4B are top and side views, respectively, of a third embodiment of the hold members.
Figure 4B:
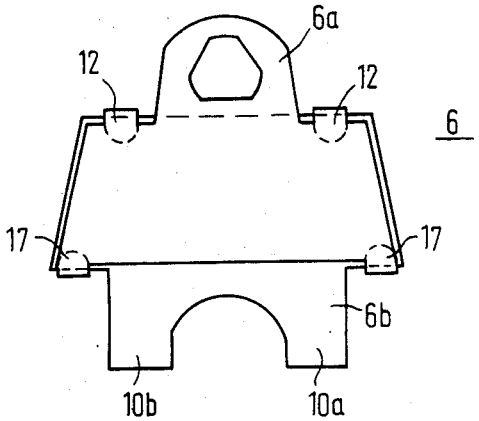

FIGS. 4A and 4B show a third embodiment of a hold member. In cases where a lateral displacement between the two parts 6*a* and 6*b* of the hold member 6 is sufficient, this type of embodiment can be chosen. Part 6*a* is again provided at its shoulders with guide flaps 12 which are bent around the part 6*b*. The shape of the shoulders is simplified in that its rim portion is perpendicular to the longitudinal axis of hold member 6. In the same way, part 6*b* is provided with shoulders whose rim portion is also perpendicular to the longitudinal axis of the hold member. At the rim portion of the end of part 6*a*, as covered by the part 6*b*, two further guide flaps 17 are provided which are bent around the shoulders on the part 6*b*. The possible lateral movement of the parts 6*a* and 6*b* with respect to each other is restricted by the respective limit stop of a guide flap 12 against the narrow free end of the part 6*a*, or of a guide flap 17 against a prong 10 and the free end of the part 6*b*.

Figure 5:
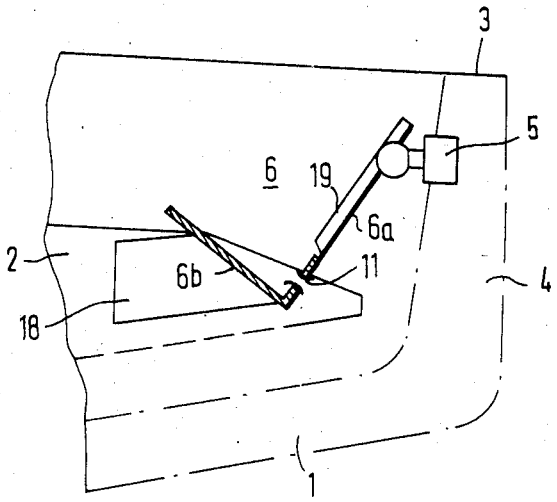
FIG. 5 is the side view of a fourth embodiment, partly in a sectional elevation.

For a color picture tube employing a frameless shadow mask 2, the hold members 6 may also be designed in accordance with the embodiment of FIG. 5. In this case, part 6*b* of the hold members simultaneously serves as a corner reinforcement 18 for the shadow mask 2. Within the overlapping of parts 6*a* and 6*b* a tubular rivet 11 serves as the swivel joint. For stiffening, part 6*a* may be provided with folded rim portions 19.

Before the shadow mask 2 is installed into the faceplate 1, the hold members 6 are connected at the respective points either to the rim portion 7 of the shadow mask 2, or directly to the shadow mask, or to the shadow mask via an intermediate member. The shadow mask 2 is inserted into the faceplate 1 and hold members 6 are simultaneously slipped on to pins 5. Because of the movability of the two parts of the hold members, there is thus effected a compensation of tolerances due to possible movement transversely in relation to the axis of symmetry of the color picture tube. In so doing, the spacing of the shadow mask from the layer of phosphor remains unchanged. After that, the hold members are fixed in their assumed position in that the parts of the hold members are connected to one another, for example, by way of spot welding with the aid of a laser beam.

The novel, simple types of hold members 6 can be mounted outside the color picture tube and secured to the shadow mask. Because of this, the spacing between the shadow mask and the layer of phosphor is fixed after the insertion to the faceplate, so that no spacing gauges are required. The compensation for any possible tolerances in direction transversely in relation to the axis of symmetry of the color picture tube is then carried out in the was as already described hereinbefore.

It is also possible to firmly connect the hold members to the then simpler designed pins within the rim portion of the faceplate, and to provide the detachable connection between the shadow mask and the ends of the hold members applied to this point.

What is claimed is:

1. A color picture tube comprising:

a faceplate, the inside surface of said faceplate being coated with a layer of phosphor;

a shadow mask;

a plurality of means for mounting said shadow mask in proximity of said faceplate, each said mounting means including:

a pin carried by said faceplate a two part hold member, a first part of said hold member being retained on said pin, a second part of said hold member being retained on said shadow mask, and means coupling said first part with said second part whereby said first and second parts can move relative to each other in a direction transverse to the longitudinal axis of said picture tube during assembly of said shadow mask to said faceplate, said first and second parts being immovably connected to one another after assembly of said shadow mask to said faceplate, said first part being a substantially flat planar first element, said second part being a substantially flat planar second element.

2. A color picture tube in accordance with claim 1, wherein:

said first and second parts of each hold member overlap each other and, within the overlapping range, are joined to one another with the aid of swivel joint.

3. A color picture tube in accordance with claim 2, wherein:

said swivel joint comprises a tubular rivet.

4. A color picture tube in accordance with claim 3, wherein:

said first part comprises two shoulders which are each provided with a guide flap extending around an end of said second part.

5. A color picture tube in accordance with claim 2, wherein:

said swivel joint comprises a first guide flap at the rim portion of said first part, said guide flap extending around said second part, and two further guide flaps at an end of said first part opposite said guide flaps and which extend around an end of said second part.

6. A color picture tube in accordance with claim 1, wherein:

said first and second parts are coupled to one another such that motion of said first part relative to said second part can occur only along a straight line.

7. A color picture tube in accordance with claim 6, wherein:

said first part has four guide flaps which embrace said second part to limit relative motion between said first and second parts to a straight line.

8. A color picture tube in accordance with claim 2 wherein:

said shadow mask is frameless; and each said second part is mounted to said shadow mask and simultaneously serves as a corner reinforcement for said shadow mask.

9. A color picture tube in accordance with claim 3 wherein:

said shadow mask is frameless; and each said second part is mounted to said shadow mask and simultaneously serves as a corner reinforcement for said shadow mask.

10. A color picture tube in accordance with claim 6 wherein:

said shadow mask is frameless; and each said second part is mounted to said shadow mask and simultaneously serves as a corner reinforcement for said shadow mask.

* * * * *